US006998376B1

(12) United States Patent
Tyborski et al.

(10) Patent No.: US 6,998,376 B1
(45) Date of Patent: Feb. 14, 2006

(54) METHOD FOR CLEANING UNITS USED TO PREPARE COFFEE

(75) Inventors: Thomas Tyborski, Dusseldorf (DE); Werner Lüdecke, Erkrath (DE)

(73) Assignee: Ecolab GmbH & Co. OHG, Dusseldorf (DE)

( * ) Notice: Subject to any disclaimer, the term of this patent is extended or adjusted under 35 U.S.C. 154(b) by 133 days.

(21) Appl. No.: 10/111,269

(22) PCT Filed: Oct. 19, 2000

(86) PCT No.: PCT/EP00/10293

§ 371 (c)(1),
(2), (4) Date: Apr. 19, 2002

(87) PCT Pub. No.: WO01/30956

PCT Pub. Date: May 3, 2001

(30) Foreign Application Priority Data

Oct. 28, 1999 (DE) ..... 199 51 798

(51) Int. Cl.
*C11D 3/22* (2006.01)

(52) U.S. Cl. ..... 510/234

(58) Field of Classification Search ..... 510/218, 510/234, 197, 111
See application file for complete search history.

(56) References Cited

U.S. PATENT DOCUMENTS

| | | | |
|---|---|---|---|
| 5,196,134 | A | 3/1993 | Jackson |
| 5,656,583 | A | 8/1997 | West |
| 5,663,132 | A | 9/1997 | Talley |
| 5,855,217 | A | 1/1999 | John |
| 5,863,345 | A | 1/1999 | Talley |
| 5,888,313 | A | 3/1999 | West |

FOREIGN PATENT DOCUMENTS

| | | |
|---|---|---|
| DE | 281119 | 8/1990 |
| DE | 41 17 972 | 12/1992 |
| DE | 43 39 502 | 6/1995 |
| DE | 199 51 798 | 5/2001 |
| EP | 0 406 695 | 1/1991 |

*Primary Examiner*—Yogendra N. Gupta
*Assistant Examiner*—John M. Petruncio
(74) *Attorney, Agent, or Firm*—Merchant & Gould P.C.

(57) ABSTRACT

In this process, the inner surfaces of the installations which have been in contact with the coffee are treated with an aqueous alkaline solution containing at least one peroxidic compound.

15 Claims, No Drawings

METHOD FOR CLEANING UNITS USED TO PREPARE COFFEE

This invention relates to a process for cleaning installations used in the food-processing industry and, more particularly, for processing coffee. A particularly preferred application is the cleaning of installations in which water-soluble coffee powder is produced from roasted coffee.

To produce water-soluble coffee powder (also known as instant coffee), freshly roasted coarsely ground coffee beans are normally extracted with water in closed extraction cells, sometimes under pressure, at elevated temperatures of about 100° C. to about 180° C. Several extraction cells are normally arranged in tandem in an alternating sequence so that the already most intensively extracted coffee is always treated with the hottest water while the freshly filled extraction cells are placed at the end of the extraction chain where they are initially treated at low temperatures with the outflowing extraction solution. Depending on the capacity of the installation, the individual extraction cells (also known as percolators) can have a holding capacity ranging from a few kilograms to one tonne of roasted coffee. They are normally made of stainless steel and are cylindrical or conical in shape. The water-containing coffee extract issuing from the last extraction cell is then freed from water under moderate conditions. Whereas previously spray drying in a heated gas stream in suitable drying towers produced a powder-form product, concentration of the extract by evaporation at low temperatures, preferably in a vacuum, is now carried out, resulting in a more granular product.

Firmly adhering deposits are formed during operation on those surfaces which come into contact with the coffee extract, above all in the extraction cells and in the pipes, and gradually disrupt the process. Accordingly, the installations are shut down after one to three weeks' operation, emptied and freed from the deposits by a complicated process. Hitherto, the technique known as cleaning in place (CIP) has been used to clean the production units. Cleaning in place is carried out with caustic soda solution under pressure at 130 to 140° C., the sollution being passed through the installation for several hours at that temperature. This process does not provide satisfactory cleaning results so that time-consuming manual recleaning work has to be done, for example in the extraction cells. Deposits inevitably remain at poorly accessible places and adversely affect production, for example by causing system blockages.

The problem addressed by the present invention was to improve and simplify the cleaning process widely in use today.

Accordingly, the present invention relates to a process for cleaning coffee-processing installations in which the inner surfaces of the installations which have been in contact with the coffee are treated with an aqueous alkaline solution containing at least one peroxidic compound.

The new process enables excellent cleaning results to be achieved in shorter times, with lower concentrations of alkali and at lower temperatures than before.

In the most simple case, the cleaning solution contains only alkali and at least one peroxidic compound as active ingredients. However, other active ingredients and auxiliaries from the group consisting of surfactants, sequestering agents, peroxide stabilizers and optionally other auxiliaries are preferably present in the cleaning solution.

Preferred alkalis are alkali metal hydroxides, more particularly sodium and/or potassium hydroxide, although less alkaline compounds, for example alkali metal carbonates, more particularly sodium carbonate and/or potassium carbonate, may also be used. Other suitable alkalis are sodium and potassium silicates and sodium and potassium phosphates.

Several alkaline active ingredients may also be used alongside one another in the cleaning solution. In one particularly preferred embodiment, alkalis from the group of alkali metal hydroxides are used. The quantities of alkalis in the cleaning solution is preferably between 0.5% by weight and 10% by weight and more preferably between 1% by weight and 3% by weight, based on the cleaning solution as a whole. Depending on the alkali used, the pH value of the solution in its in-use concentration is preferably between about 10 and about 14, as measured at room temperature.

Suitable peroxidic compounds are both inorganic and organic peroxidic compounds. Examples of suitable inorganic peroxides are hydrogen peroxide, perborates, more particularly sodium perborate, salts of monoperoxosulfuric acid, more particularly potassium monopersulfate, and adducts of hydrogen peroxide with inorganic compounds, more particularly the adduct with sodium carbonate known as sodium percarbonate, and adducts with sodium phosphates. Suitable organic peroxy compounds are primarily the peroxycarboxylic acids, for example peroxyacetic acid, peroxypropionic acid and monoperoxyphthalic acid. Hydrogen peroxide, compounds which yield hydrogen peroxide, more particularly sodium perborate, sodium carbonate, and organic peracids are particularly preferred for the purposes of the process according to the invention. Mixtures of several peroxidic compounds may also be used. The peroxidic compounds are used in the cleaning solution in such quantities that preferably at least 10 ppm of active oxygen and more preferably at least 50 ppm of active oxygen are present in the solution over a prolonged period so that a satisfactory solution is obtained in reasonable times. In general, quicker cleaning is obtained with relatively high active oxygen contents. For economic reasons, an average of no more than 15,000 ppm of active oxygen and, more particularly, no more than 5,000 ppm of active oxygen is used. It is obvious that the active oxygen concentration in the solution can never be constant for significant periods on account of the decomposition of the peroxidic compound in the heated alkaline solution. Accordingly, the concentration figures mentioned above should be regarded purely as guide values to be adhered to for most of the cleaning process. In one preferred embodiment of the process according to the invention, peroxidic compound is re-added one or more times to the heated alkaline cleaning solution in the installation in order to correct the reduction in concentration of active oxygen by decomposition.

The main object of using surfactants in the cleaning solution is to accelerate the wetting of the surfaces and the penetration of the cleaning component into the soil. Basically, surfactants from any of the known classes, i.e. anionic surfactants, nonionic surfactants, cationic surfactants and amphoteric surfactants, may be used although only extremely low-foaming surfactants should be considered for the process according to the invention if the need for foam inhibitors is to be avoided. Accordingly, nonionic surfactants are particularly preferred, the nonionic surfactant preferably being selected from the group of optionally end-capped alkoxylated fatty alcohols and/or the alkyl polyglycosides and/or alkoxylated fatty amines.

Suitable alkoxylated fatty alcohols are, for example, $C_{8-18}$ alkyl polyethylene glycol polypropylene glycol ethers containing up to 8 moles ethylene oxide (=EO) and 8 moles propylene oxide (=PO) units in the molecule. In addition, the addition of tallow alcohol ethoxylated with 30 EO groups and the addition of oleyl-cetyl alcohol ethoxylated with 5 EO groups have been found to have a positive effect on the cleaning result. However, other known nonionic surfactants, such as for example $C_{12-18}$ alkyl polyethylene glycol polybutylene glycol ethers containing up to 8 moles ethylene oxide and 8 moles butylene oxide units in the molecule and end-capped alkyl polyalkylene glycol mixed ethers, may also be used. Suitable alkoxylated fatty amines are, for example, $C_{8-18}$ alkylamines ethoxylated with 8 to 16 EO groups.

In the context of the process according to the invention, sequestering agents are understood to be substances which are capable of eliminating the harmful effects of water hardness, irrespective of whether they have to be used in stoichiometric quantities for this purpose or whether less than stoichiometric quantities will suffice. Examples of such sequestering agents are polymeric phosphates, more particularly pentasodium triphosphate, polycarboxylic acids, hydroxypolycarboxylic acids, more particularly gluconic acid and citric acid, and phosphonocarboxylic acids, for example 2-phosphonobutane-1,2,4-tricarboxylic acids, and water-soluble salts thereof, more particularly alkali metal salts.

Suitable peroxide-stabilizing compounds for the process according to the invention are, above all, heavy-metal-complexing compounds. Their principal function is to prevent uncontrolled decomposition of the peroxidic compounds by any heavy metal traces present. Examples of such complexing agents are aminopolycarboxylic acids, such as ethylenediamine tetraacetic acid, and more particularly polyphosphonic acids and aminopolyphosphonic acids, such as hydroxyethane-1,1-diphosphonic acid, ethylenediamine tetramethylene phosphonic acid and diethylene triamine pentamethylene phosphonic acid, and water-soluble salts of these complexing agents, more particularly alkali metal salts. The quantity in which the peroxide stabilizers are used depends upon their effectiveness and is generally not more than 0.5% by weight and preferably not more than about 0.1% by weight, based on the cleaning solution as a whole.

In individual cases, the cleaning solution may contain other auxiliaries and additives should this seem appropriate for certain reasons. Examples of such auxiliaries and additives are foam inhibitors and solubilizers. Their concentration is governed by the particular application envisaged.

In the process according to the invention, the alkaline cleaning solution is intended to act on the inner surfaces to be cleaned in the installations. Temperatures above 50° C. are preferably applied. It is of considerable advantage that only rarely are temperatures above about 100° C. needed for rapid cleaning in the process according to the invention so that there is normally no need to apply pressure. Cleaning temperatures of 50 to about 95° C. are particularly preferred. The time required for complete cleaning will of course depend on the particular cleaning temperature selected and also to a very large extent on the composition of the cleaning solution. In virtually every case, however, a cleaning result entirely satisfactory for such installations can be achieved in about 2 to about 10 hours.

The treatment of the surfaces with the alkaline peroxidic cleaning solution may be carried out in various ways in the process according to the invention. For example, the inner walls of relatively large cells may be sprayed with the cleaning solution from inside and, if desired, may also be manually treated with the cleaning solution. In a preferred embodiment, however, the cleaning solution is passed, preferably circulated, through the installation, more or less completely filling all pipes and cells. This method is also known generally as cleaning in place (CIP). The heating systems of the installation itself may optionally be used to heat the cleaning solution. In the case of relatively large installations, it may be advisable to treat the installation with the cleaning solution in sections in order to keep the quantity of cleaning solution within limits.

In the manufacture of coffee, the demands on cleaning are normally at their greatest in the extraction cells. Since six to eight extraction cells are generally present, the possibilities for variation are many and varied. For example, the following procedures are possible:

1. Simultaneous Cleaning of all Cells in a Single Cleaning Operation

The alkaline cleaning solution is pumped into the system via a CIP storage tank in which the concentration required for cleaning has already been established. The flow of cleaning solution can be variably controlled so that the cells can be cleaned in succession, for example in dependence upon the degree of soiling. If, for example, the cleaning solution flows first through cell 1, the peroxide component should preferably be added in the vicinity of and before cell 1 although it may also be added elsewhere, for example directly to the cells, depending on the cleaning requirements and the design of the installation.

The cleaning solution flows upwards through the cells. After cell 1, it flows successively through the other cells in any order. After flowing through the last cell, the cleaning solution may be returned to cell 1. The cleaning solution may be circulated over the corresponding cleaning periods, depending on the degree of soiling/fouling. The peroxide component is added periodically or continuously.

For economic reasons, these processes are particularly preferred for small installations with small CIP volumes (up to ca. 5 $m^3$).

2. Cleaning of all Cells in Succession with Variable Peroxide Input

The cleaning process is carried out in much the same way as described in 1., except that the addition of the peroxide component is variable.

a) Addition of peroxide at one point only, preferably where heavy soiling/fouling is present.

b) The addition varies according to the sequence of the cells to be cleaned so that each cell is charged with "fresh" peroxide component for a certain time. For example, the following procedure may be applied: the cleaning solution flows first through cell 1 so that peroxide is added before cell 1. The cleaning solution then flows through cell 2 and the other cells. The production of oxygen and hence the oxidizing effect diminish from cell to cell. After a certain time, the product stream is reversed so that the cleaning solution flows first through cell 2, then through cell 3 and thereafter through the other cells. Cell 1 thus represents the end of the cleaning circuit. In this case, peroxide is added before cell 2, whereafter cell 3 represents the beginning of the cleaning circuit (addition of peroxide before cell 3), so that cell 3 is charged with fresh peroxide.

c) The effect described in b) (=fresh peroxide solution for all cells) may also be achieved by providing addition points before each cell.

3. Staggered Cleaning of the Cells

Cleaning of the cells in sections is particularly recommended for large installation volumes (>5 $m^3$). The following possibilities are available:

a) Only one cell at a time is cleaned.

Example: Cell 1 is cleaned. After cleaning, the solution is pumped into cell 2 or transported, for example, by steam or gas, for example into cell 2.

b) Two cells are cleaned at the same time.

Example: The cleaning solution flows through cell 1. From there it passes into cell 2 and then back into cell 1 (peroxide added before cell 1). After a certain time, the cleaning solution is transported from cell 1 into cell 3. Cell 2 now represents the beginning of the circuit (peroxide added before cell 2). This procedure is continued until all cells have been cleaned.

Cleaning may be similarly carried out where three or more cells are simultaneously cleaned. With proper planning, this process has the advantage that it may be set up in such a way that the coffee extraction cycle may be continued in the cells free from cleaning solution so that production does not have to be stopped for cleaning 4. Cleaning of the Cells by Spraying Cleaning performance can be improved even further by the additional provision of mechanical aids, for example spray nozzles/heads, in the cells and cells. In this case, the cleaning solution flows downwards.

Besides the extraction cells, vessels, evaporators and other items of equipment are cleaned by the process according to the invention in the coffee-producing factory. A special application is the cleaning of evaporators. In this case, the usual pumping of liquid by centrifugal pumps may be supported by the vacuum delivery of the cleaning chemicals, the addition of the peroxide component having to be adjusted in such a way that the reduced pressure is maintained (formation of oxygen<capacity of vacuum pump). The peroxide component is preferably added immediately before or directly to the evaporators.

The same applies to other parts of the installation where vacuum pumps are used to transport the cleaning solution.

In order to prepare the cleaning solution, all the active ingredients may be individually added to a corresponding quantity of water before or after heating. In general, however, it is more appropriate to prepare the cleaning solution from two separate water-containing concentrates of which one contains the alkali components and the other the peroxidic compounds—respectively in conjunction with other active ingredients and auxiliaries—in the necessary quantities. The use of two separate liquid concentrates facilitates automatic addition and at the same time provides for high storage stability of the concentrates before use through the separation of alkalis and peroxidic compounds. Other auxiliaries and additives which may be used for alkali-containing concentrate are, in particular, surfactants and sequestering agents whereas active ingredients and auxiliaries from the group of surfactants and peroxide stabilizers are preferably present in the second concentrate containing peroxidic compounds.

In one particularly preferred embodiment of the process according to the invention, the items of equipment to be cleaned are first filled with an alkaline cleaning solution which does not yet contain any peroxidic compounds and this cleaning solution is circulated through the installation until the required cleaning temperature is reached. Only then are the peroxidic compounds added—preferably in the form of the above-mentioned concentrate—to the cleaning solution. In one particularly preferred embodiment, this addition is made immediately before the particularly heavily soiled parts of the installation in order to establish a particularly high concentration of active oxygen at those places. If necessary, peroxidic compounds may be added continuously or repeatedly throughout the entire cleaning process, particularly when the composition of the cleaning solution is geared to rapid decomposition of the peroxidic compounds.

After they have been treated with the alkaline peroxidic cleaning solution, the installations are preferably rinsed with drinking water (temperature 20 to 60° C., time 1 to 2 seconds).

The cleaning solution may optionally be stored pending the next cleaning cycle, possible reductions in the content of peroxidic components preferably being corrected by addition of fresh peroxide before any further cleaning tasks are carried out. In order to reduce the organic burden, which stems primarily from the soil cleaned off, and hence to maintain cleaning performance, the cleaning solution is preferably freed from particles by centrifuges, filters or other separators. This can be done both during and after cleaning. An acidic cleaning step may have to be carried out at regular intervals (every three to six months), depending on the hardness of the water.

EXAMPLES

1. Composition of the Active-Substance Concentrates

Tables 1 and 2 below show the composition of ten alkaline active-substance concentrates (A1 to A10) and seven concentrates containing peroxidic active substances (B1 to B7) which were used to prepare the cleaning solution in the tests described in the following.

TABLE 1

| | Active-substance concentrate 1 (alkaline) (composition in % by weight) | | | | | | | | | |
|---|---|---|---|---|---|---|---|---|---|---|
| Ingredient | A1 | A2 | A3 | A4 | A5 | A6 | A7 | A8 | A9 | A10 |
| Caustic soda, 50% | 50.0 | 50.0 | 50.0 | 66.0 | 66.0 | 66.0 | 50.0 | 50.0 | 50.0 | — |
| Caustic potash, 45% | 20.0 | 20.0 | 20.0 | — | — | — | 20.0 | 20.0 | 20.0 | — |
| Sodium carbonate | — | — | — | — | — | — | — | — | — | 35.0 |
| Phosphonic acid | 6.0 | — | — | 6.0 | — | — | 6.0 | — | — | 6.0 |
| Na gluconate techn. | — | 3.5 | — | — | 3.5 | — | — | 3.5 | — | — |
| Na tripolyphosphate | — | — | 4.0 | 1.0 | — | 4.0 | — | — | 4.0 | — |
| End-capped fatty alcohol ethoxylate A | 1.0 | 1.0 | 1.0 | 1.0 | 1.0 | 1.0 | — | — | — | 1.0 |
| End-capped fatty alcohol ethoxylate B | — | — | — | — | — | — | 1.0 | 1.0 | 1.0 | — |
| Alkyl polyglycoside | 1.0 | 1.0 | 1.0 | 1.0 | 1.0 | 1.0 | 1.0 | 1.0 | 1.0 | 1.0 |
| Water | 22.0 | 24.5 | 24.0 | 25.0 | 28.5 | 28.0 | 21.0 | 24.5 | 24.0 | 57.0 |

A and B are commercially available end-capped nonionic surfactants, A being end-capped by a butyl group and B by a methyl group.

TABLE 2

| Ingredient | Active-substance concentrate 2 (containing peroxide) (composition in % by weight) | | | | | | |
|---|---|---|---|---|---|---|---|
| | B1 | B2 | B3 | B4 | B5 | B6 | B7 |
| Acetic acid | 10.0 | — | — | 10.0 | — | — | — |
| Peracetic acid | 1.5 | — | — | 1.5 | — | — | — |
| Hydrogen peroxide, 70% | 15.0 | 50.0 | — | 15.0 | 50.0 | — | 100 |
| Na perborate | — | — | 30.0 | — | — | 30.0 | — |
| End-capped fatty alcohol ethoxylate A | 3.5 | 3.5 | 3.5 | — | — | — | — |
| End-capped fatty alcohol ethoxylate B | — | — | — | 3.5 | 3.5 | 3.5 | — |
| Phosphonic acid | 1.0 | 1.0 | 1.0 | 1.0 | 1.0 | 1.0 | — |
| Na cumenesulfonate | 7.0 | 7.0 | 7.0 | 7.0 | 7.0 | 7.0 | — |
| Water | 62.0 | 38.5 | 57.5 | 62.0 | 38.5 | 57.5 | — |

2. The cleaning process was tested in the laboratory on stainless steel plates (2×50×100 mm) on which coffee powder (ca. 1 g) had been burnt in for 10 hours in an oven heated to 200° C. The cleaning performance was gravimetrically evaluated by weighing out the dried plates before and after the cleaning treatment in relation to the weight of the cleaner plates. For cleaning, the plates were immersed for 10 minutes in the cleaning solution heated to 70° C. The cleaning solution was not stirred during the cleaning treatment. 2.5% by volume of alkaline concentrates A1 to A10 and 0.7% by volume of peroxidic concentrates B1 to B7 were used to prepare the cleaning solution, the peroxidic concentrates only being added after the alkaline solution had been heated. For comparison, water, 10% caustic soda, 7.5% phosphoric acid, 10% diluted alkali concentrate A1 and 10% diluted peroxidic concentrate B2 were individually used under the same conditions for cleaning. After the treatment, the plates were immersed in water and then dried for 8 hours at 80° C. in a heating cabinet. The results were evaluated gravimetrically and visually. Table 3 below shows the cleaning results obtained in percent, 100% signifying complete removal of the soil. The excellent cleaning results obtained by this simple laboratory test were fully confirmed by a CIP process carried out in a pilot coffee extraction plant.

TABLE 3

| Formulation | Cleaning Performance in % |
|---|---|
| Water | 42 |
| NaOH | 50 |
| $H_3PO_4$ | 40 |
| A1 | 57 |
| B2 | 49 |
| A1 + B1 | 100 |
| A1 + B2 | 95 |
| A1 + B3 | 90 |
| A1 + B4 | 96 |
| A1 + B5 | 98 |
| A1 + B6 | 90 |
| A1 + B7 | 91 |
| A2 + B1 | 93 |
| A2 + B2 | 92 |
| A2 + B3 | 89 |
| A2 + B4 | 98 |
| A2 + B5 | 98 |
| A2 + B6 | 99 |
| A2 + B7 | 92 |
| A3 + B1 | 98 |

TABLE 3-continued

| Formulation | Cleaning Performance in % |
|---|---|
| A3 + B2 | 97 |
| A3 + B3 | 87 |
| A3 + B4 | 95 |
| A3 + B5 | 94 |
| A3 + B6 | 97 |
| A3 + B7 | 87 |
| A4 + B1 | 100 |
| A4 + B2 | 98 |
| A4 + B3 | 90 |
| A4 + B4 | 95 |
| A4 + B5 | 96 |
| A4 + B6 | 97 |
| A4 + B7 | 85 |
| A5 + B1 | 88 |
| A5 + B2 | 87 |
| A5 + B3 | 65 |
| A5 + B4 | 85 |
| A5 + B5 | 84 |
| A5 + B6 | 86 |
| A5 + B7 | 84 |
| A6 + B1 | 90 |
| A6 + B2 | 91 |
| A6 + B3 | 83 |
| A6 + B4 | 92 |
| A6 + B5 | 88 |
| A6 + B6 | 87 |
| A6 + B7 | 82 |
| A7 + B1 | 95 |
| A7 + B2 | 87 |
| A7 + B3 | 89 |
| A7 + B4 | 65 |
| A7 + B5 | 84 |
| A7 + B6 | 86 |
| A7 + B7 | 79 |
| A8 + B1 | 100 |
| A8 + B2 | 95 |
| A8 + B3 | 86 |
| A8 + B4 | 95 |
| A8 + B5 | 95 |
| A8 + B6 | 97 |
| A8 + B7 | 90 |
| A9 + B1 | 99 |
| A9 + B2 | 96 |
| A9 + B3 | 88 |
| A9 + B4 | 94 |
| A9 + B5 | 97 |
| A9 + B6 | 96 |
| A9 + B7 | 78 |
| A10 + B1 | 80 |
| A10 + B2 | 85 |
| A10 + B3 | 86 |
| A10 + B4 | 81 |
| A10 + B5 | 84 |
| A10 + B6 | 86 |
| A10 + B7 | 83 |

We claim:

1. A process for cleaning deposits on inner surfaces of installations for producing water soluble coffee powder, comprising treating the inner surfaces of the installations containing deposits with an aqueous alkaline solution containing at least one peroxidic compound, wherein the deposits are a result of extracting coffee at a temperature of about 100° C. to about 180° C.

2. A process as claimed in claim 1, wherein the quantity of alkali in the aqueous alkaline solution is from 0.5% by weight to 10% by weight, based on the aqueous alkaline solution as a whole.

3. A process as claimed in claim 1, wherein the aqueous alkaline solution contains at least 10 ppm of active oxygen and no more than 15,000 ppm of active oxygen, based on the aqueous alkaline solution as a whole.

4. A process as claimed in claim 1, wherein the treatment of the surfaces is carried out at a temperature of 50 to 100° C.

5. A process as claimed in claim 1, wherein the alkaline solution containing a peroxidic compound is passed through the installation.

6. A process as claimed in claim 5, wherein peroxidic compound is re-added to the alkaline solution during the cleaning treatment.

7. A process as claimed in claim 1, wherein the peroxidic compound is selected from the group consisting of hydrogen peroxide, compounds yielding hydrogen peroxide, organic per acids and mixtures thereof.

8. A process as claimed in claim 1, wherein the alkaline cleaning solution containing a peroxidic compound contains other active ingredients and auxiliaries from the group consisting of surfactants, sequestering agents, peroxide stabilizers and mixtures thereof.

9. A process as claimed in claim 1, wherein the cleaning solution is prepared using two separate water-containing concentrates of which one contains an alkali, and the other contains at least one peroxidic compound.

10. A process as claimed in claim 1, wherein the peroxidic compound is only added to the alkaline cleaning solution after the alkaline cleaning solution has been heated to the temperature for the cleaning treatment.

11. A process as claimed in claim 1, wherein the peroxidic compound is periodically or continuously added to the cleaning solution immediately before particularly heavily soiled parts of the installation.

12. A process as claimed in claim 1, wherein the installation is cleaned in sections.

13. A process as claimed in claim 9, wherein the alkali comprises at least one of alkali metal hydroxide, alkali metal carbonate, and mixtures of alkali metal hydroxide and alkali metal carbonate.

14. A process as claimed in claim 9, wherein the water-containing concentrate containing alkali further comprises at least one of surfactants, sequestering agents, and mixtures of surfactants and sequestering agents.

15. A process as claimed in claim 9, wherein the water-containing concentrate containing at least one peroxidic compound comprises at least one of surfactants, peroxide stabilizers, and mixture of surfactants and peroxide stabilizers.

* * * * *